US007360997B2

(12) United States Patent
Wagner et al.

(10) Patent No.: US 7,360,997 B2
(45) Date of Patent: Apr. 22, 2008

(54) VIBRATION DAMPER COATING

(75) Inventors: William Kent Wagner, Somerville, OH (US); John Frederick Ackerman, Laramie, WY (US); Kenneth Lee Johnson, Loveland, OH (US)

(73) Assignee: General Electric Company, Schenectady, NY (US)

( * ) Notice: Subject to any disclaimer, the term of this patent is extended or adjusted under 35 U.S.C. 154(b) by 98 days.

(21) Appl. No.: 11/244,938

(22) Filed: Oct. 6, 2005

(65) Prior Publication Data

US 2007/0081901 A1 Apr. 12, 2007

(51) Int. Cl.
*F03B 3/12* (2006.01)
*F03B 3/00* (2006.01)

(52) U.S. Cl. ..... 416/241 A; 416/500

(58) Field of Classification Search ..... 416/241 A, 416/241 B, 241 R, 500; 428/632
See application file for complete search history.

(56) References Cited

U.S. PATENT DOCUMENTS 3,357,850 A * 12/1967 Baker ..... 416/229 A
3,368,795 A 2/1968 Bolin et al.
3,399,103 A 8/1968 Salyer et al.
3,640,830 A 2/1972 Oberst et al.
3,658,635 A 4/1972 Eustice
3,744,931 A 7/1973 Cavanagh
3,758,233 A 9/1973 Cross et al.
3,833,404 A 9/1974 Sperling et al.
3,994,845 A 11/1976 Blachford
4,034,639 A 7/1977 Caldwell
4,097,193 A 6/1978 Brunsch et al.
4,447,493 A 5/1984 Driscoll et al.
4,483,268 A 11/1984 Pichl
4,494,287 A 1/1985 Cruzen et al.
4,512,720 A 4/1985 Cholakis
4,623,586 A 11/1986 Umeya et al.
4,706,928 A 11/1987 Hyll
4,822,026 A 4/1989 Schobermayr et al.
4,822,834 A 4/1989 Blevins
4,902,368 A 2/1990 Oldham
5,033,579 A 7/1991 Vanderstraeten
5,066,540 A 11/1991 Mosser et al.
5,066,708 A 11/1991 Koller, Sr. et al.
5,108,262 A 4/1992 Crane (Continued)

FOREIGN PATENT DOCUMENTS

EP 0516081 12/1992

(Continued)

*Primary Examiner*—Edward K. Look
*Assistant Examiner*—Nathan Wiehe
(74) *Attorney, Agent, or Firm*—McNees Wallace & Nurick LLC

(57) ABSTRACT

A coated fan rotor blade and method for coating a fan rotor blade. The coated fan rotor blade includes a fan rotor blade; and a coating disposed on said fan rotor blade. The coating comprises a binder; and a filler made up of a plurality of particles. The filler material is incorporated into the binder material, and the particles in the filler interact to produce vibrational damping. In particular, the coating includes small, dense, flattened particles or plates that are incorporated into a thin layer of visco-elastic material, such as rubber, silicone, fluoro-elastomer, or urethane and bonded to the surface of the rotor blade to provide damping of high frequency excitation.

18 Claims, 5 Drawing Sheets

U.S. PATENT DOCUMENTS

| | | | | |
|---|---|---|---|---|
| 5,262,232 | A | 11/1993 | Wilfong et al. | |
| 5,401,149 | A | 3/1995 | Tsuru et al. | |
| 5,464,659 | A | 11/1995 | Melancon et al. | |
| 5,474,840 | A | 12/1995 | Landin | |
| 5,856,022 | A | 1/1999 | McCormick et al. | |
| 5,858,521 | A | 1/1999 | Okuda et al. | |
| 5,879,753 | A | 3/1999 | Zajchowski et al. | |
| 5,939,179 | A | 8/1999 | Yano et al. | |
| 6,059,533 | A | 5/2000 | Stoker et al. | |
| 6,123,171 | A | 9/2000 | McNett et al. | |
| 6,147,150 | A | 11/2000 | Ohira et al. | |
| 6,153,709 | A | 11/2000 | Xiao et al. | |
| 6,216,817 | B1 | 4/2001 | Kannon et al. | |
| 6,224,341 | B1 | 5/2001 | Fricke | |
| 6,277,903 | B1 | 8/2001 | Sophiea et al. | |
| 6,379,804 | B1 * | 4/2002 | Ackerman et al. | 428/433 |
| 6,465,090 | B1 * | 10/2002 | Stowell et al. | 428/325 |
| 6,521,293 | B1 | 2/2003 | Kojima et al. | |
| 6,558,814 | B2 | 5/2003 | Spitsberg et al. | |
| 2004/0096332 | A1 * | 5/2004 | Shipton et al. | 416/241 R |
| 2005/0271881 | A1 | 12/2005 | Hong | |

FOREIGN PATENT DOCUMENTS

| | | |
|---|---|---|
| EP | 0952192 | 10/1999 |
| EP | 1026366 | 8/2000 |
| GB | 2397257 A | 7/2004 |
| GB | 2407523 A | 5/2005 |
| JP | 1003297 | 1/1989 |
| JP | 09192571 | 7/1997 |

* cited by examiner

VIBRATION DAMPER COATING

BACKGROUND OF THE INVENTION

The present invention relates generally to vibration damping coatings, particularly for use on structural components of gas turbine engines subject to vibratory energy.

In gas turbine engines, there are a number of rotating and fixed structural components subject to vibratory energy. Components subject to vibratory energy include blades, vanes, and foils. The components are generally beam-like structures, often cantilevered, that are subject to natural frequencies of vibrations, or resonant frequencies. The natural frequencies of vibration, or resonant frequencies are excited through mechanisms, such as mechanical vibration and fluid flow. Natural frequencies are frequencies at which an ideal system will vibrate with zero input excitation power. In a real system there exists a certain amount of intrinsic or added damping. The real system will respond at the natural frequencies and displacement amplitude will grow to the point that damping dominates or until the part fails. Damping is the conversion of mechanical energy to heat.

Rotating components such as fan rotor blades or blisks are prone to vibration at certain speeds. Fan rotor blades are blades that are fastened to a center mounting. Fan rotor blades have the advantage that individual blades may be removed, repaired and/or replaced. A blisk is a single-piece component, consisting of a disk and blades. Blisks are also known as integrally bladed rotors or IBRs. Blisks have the advantage over the conventional disk and blade arrangement of potential weight saving through the elimination of the mountings that secure the blade root to the disk. However, like the fan rotor blades, vibration leads to fatigue and eventually to pre-mature, and often catastrophic, failure of the component.

Of the vibrating components of the gas turbine engine, the rotating components are under the most stress and are the most difficult to treat due, in large part, to the combined effects of mechanical and fluid dynamics, the latter of which is associated with fluid turbulence.

Vibration originates from a variety of sources. For example, one source of vibration energy in fan rotor blades or blisks is mechanical imbalance. Another source of vibration energy is fluid dynamic loading. Fluid dynamic loading is a result of vortex shedding at the trailing edge of a rotating blade. If one or more natural frequencies of the blade lie within the vortex shedding frequencies, then the blade will be excited into motion, and begin vibrating. Damping can be used to reduce the amount of vibration.

For fan blades and stator vanes, previous damping treatments have most often been applied at the base of the components, where they attach to the rest of the machine, at the tip in the form of a shroud for the blades, and at the inner and outer shroud for vanes. Damping at the blade tip by a shroud is effective in reducing the dynamic vibration levels of cantilevered blades, but has the drawback of increased weight and centrifugal forces imposed on the blades and the rotor hub. Intermediate damping positions have been used in the form of extensions normal to the blade that are positioned between the blades at locations part way between the blade root and tip. The extensions normal to the blade have the drawback that they impose extra weight, and disturb the fluid flow around the appendage, which reduces the efficiency of the engine. Another attempt to reduce vibration included friction devices mounted at the connections between the blade and the hub. These friction devices rely on the relative motion between the blade base and the hub.

Vibrational energy is extracted from the blade and converted to heat. This approach has the drawback that the motion of the blade is low at the junction between the blade and the hub. Additionally, this approach is only effective when the friction devices are placed at locations of large displacement.

Another approach for reducing vibration includes dynamic absorbers. Dynamic absorbers reduce vibration levels in many types of devices. In one application, a liquid is placed within a chamber of a hollow blade. The liquid oscillates within the chamber, which is sized to produce a resonant frequency approximately the same as that of a dominant resonance in the blade. The combination of the blade resonance and the fluid resonance form a system in which energy from the blade, which has low intrinsic damping is coupled to energy in the liquid, which through proper selection of viscosity, has high intrinsic damping. This approach has the drawback that the dynamic absorber formed by the liquid oscillator only extracts energy from the blade in a relatively narrow band of frequencies. Since the excitation mechanism is typically a larger band of frequencies then a narrowband absorber, the dynamic absorber will only provide partial vibrational damping.

In still another approach, treatment of vibrations have included hollowing out the blade structure and filling the void with a high-density granular fill, such as sand or lead shot, or a low-density material, such as low-density polymer or ceramic. Broadband treatment has been achieved by filling hollow shafts with sand, but the enhanced performance comes at the cost of a substantial weight increase that is unsuitable for many applications.

Accordingly, what is needed is a method for damping that avoids the mechanical and manufacturing disadvantages encountered in the prior art discussed above, while still providing damping effect that increases the life and structural integrity of components subject to vibrational energy.

SUMMARY OF THE INVENTION

The present invention includes a coated fan rotor blade. The coated fan rotor blade includes a fan rotor blade; and a coating disposed on said fan rotor blade. The coating comprises a binder; and a filler material made up of a plurality of particles. The filler material is incorporated into the binder material, and the particles of the filler material interact with the binder to produce vibrational damping.

Another embodiment of the invention includes a method for coating a fan rotor blade with a vibration damping coating. The method comprises coating at least a portion of a fan rotor blade with a coating composition. The coating composition comprises a binder material and a filler material, wherein the filler material is a plurality of particles. The particles interact to produce vibrational damping.

An advantage of the present invention is that the vibration coating of the present invention provides a rotor blade having an increased life. In particular, blisk rotor designs incorporating the coating of the present invention have a reduced rate of high cycle fatigue.

Another advantage is that the vibration coating of the present invention is capable of being retrofitted on fan rotor blades already in use or applied to new fan rotor blades, with no structural modifications required.

Another advantage of the coating associated with the present invention is the ability to be repaired in the field.

Another advantage of the present invention is that the coating of the present invention may be applied by a relatively simple and inexpensive method, requiring little specialized equipment. Therefore, the coating of the present invention is capable of being repaired in the field.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

The present invention includes a high frequency damping coating having small, dense, flattened particles or plates that are incorporated into a thin layer of visco-elastic material such as rubber, silicone, fluoro-elastomer, or urethane and bonded to the surface of a fan rotor blade to provide damping of high frequency excitation.

Figure 1:
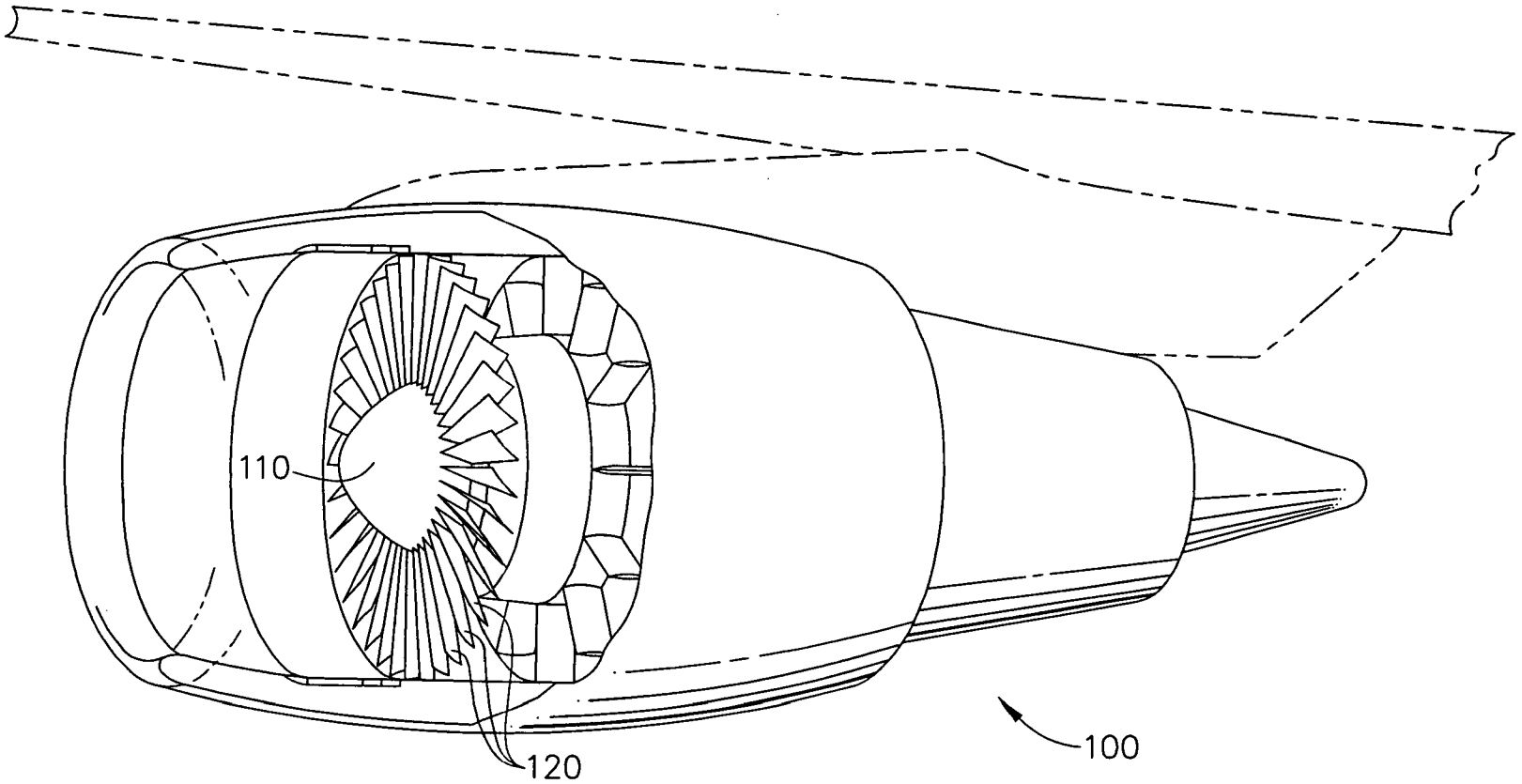
FIG. 1 illustrates a cutaway view of a gas turbine engine.

FIG. 1 shows a cutaway view of a gas turbine engine 100 having a fan 110. The fan 110 includes a plurality of fan blades 120. The fan 110 is mounted inside the gas turbine engine 100 and rotates to provide thrust. As the fan 110 rotates, vibration mechanisms, such as mechanical imbalance or fluid dynamic loading, act upon the fan blades 120 and vibration may occur. The present invention includes an embodiment including a method wherein a vibration damping coating is applied to fan blades 120.

Figure 2:
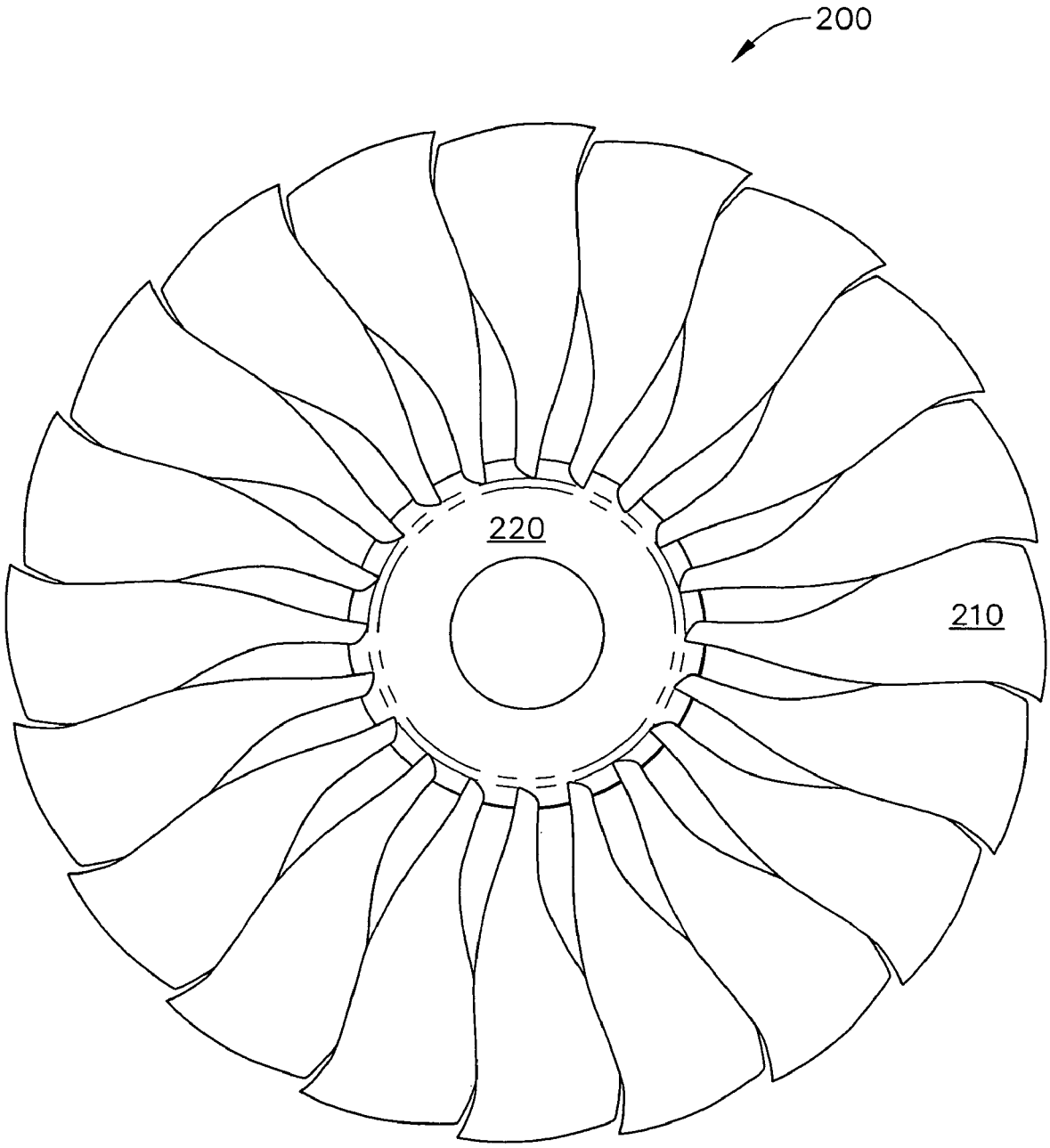
FIG. 2 illustrates a perspective view of a blisk.

FIG. 2 shows a blisk 200, or single-piece bladed disk. The blisk 200 includes a portion including a plurality of blisk blades 210 and a portion that includes a disk 220. The disk 220 allows attachment to a shaft (not shown) to allow rotation inside a gas turbine engine 100. Like the fan 110 shown in FIG. 1, the blisk 200 rotates within a gas turbine engine 100 and is subject to vibration. The present invention includes an embodiment wherein a vibration damping coating is applied to the blisk 200.

Figure 3:
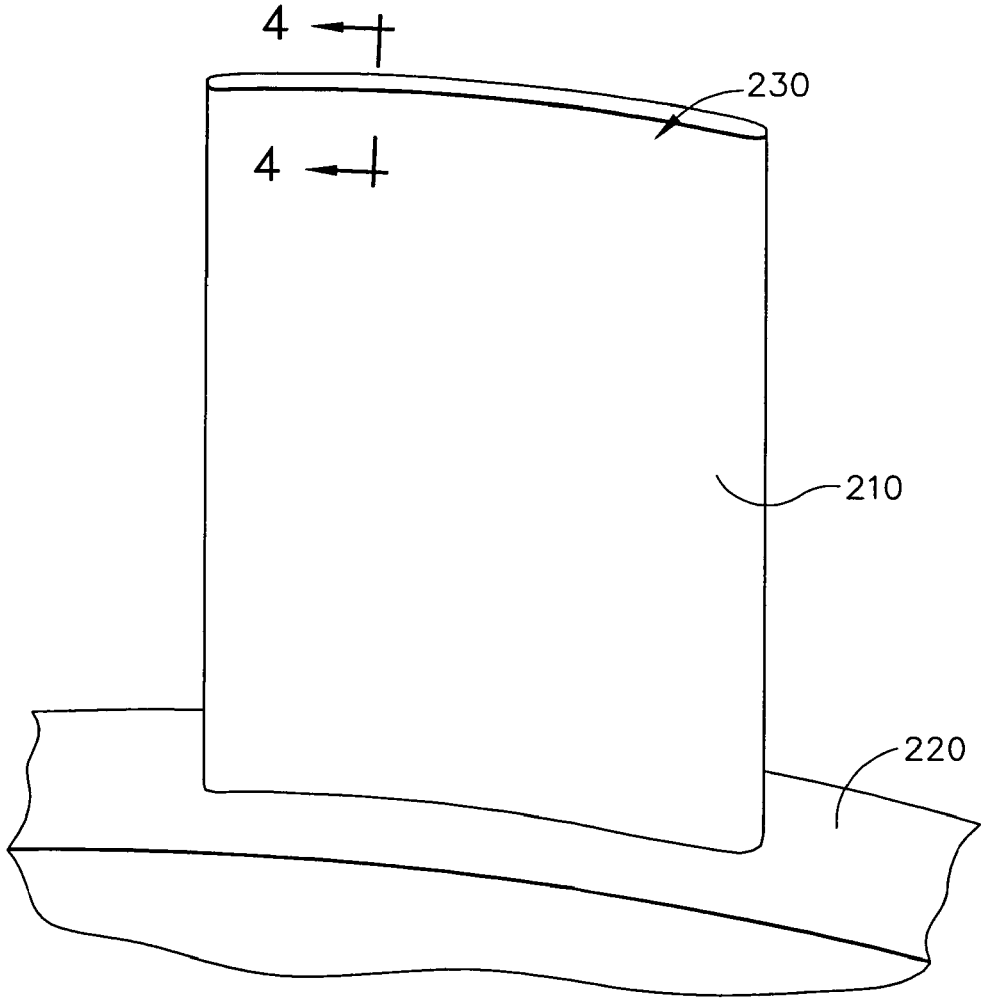
FIG. 3 illustrates a fan rotor blade according to one embodiment of the invention.

FIG. 3 shows a blisk blade 210 according to an embodiment of the present invention. Although FIG. 3 is depicted as a blisk blade 210, a fan blade 120 may also be coated with the coating composition of the present invention. The blisk blade 210 extends from the disk 220. The coating is applied to the blisk blade 210 and may be extended to include the entire blisk 200 or disk 220. The application of a coating according to the present invention provides vibrational damping of the blisk blade 210, particularly in the outer diameter regions 230.

Figure 4:
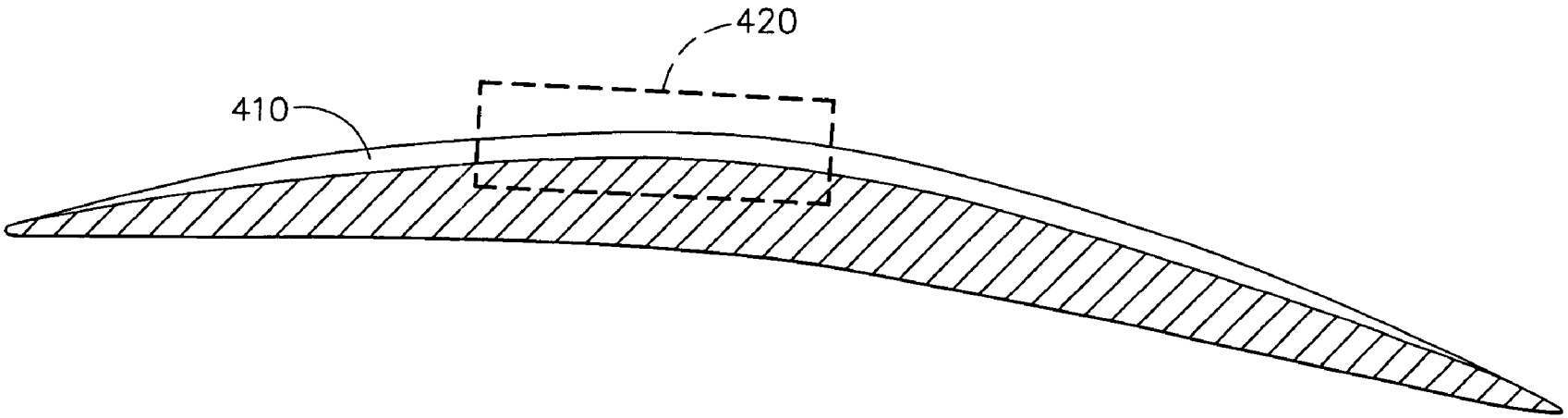
FIG. 4 illustrates a blade including cutaway view of a coating system according to one embodiment of the invention.

FIG. 4 shows a cutaway view 4-4, as shown in FIG. 3, where the view shows a cross-section of a coated fan blade 120 according to an embodiment of the present invention. FIG. 4 shows a blisk blade 210 having a damping coating 410 disposed on a surface thereon. Although FIG. 4 depicts a damping coating 410 on a blisk blade 210, the damping coating 410 may also be disposed on a fan blade 120. The damping coating 410 preferably includes a thickness that varies across the surface of the blisk blade 210. In the embodiment shown in FIG. 4, the damping coating 410 has a maximum thickness near the center of the blisk blade 210 and a minimum thickness near the edges of the blisk blade 210. The variation in thickness provides a reduced susceptibility to delamination, while maintaining vibrational damping.

Figure 5:
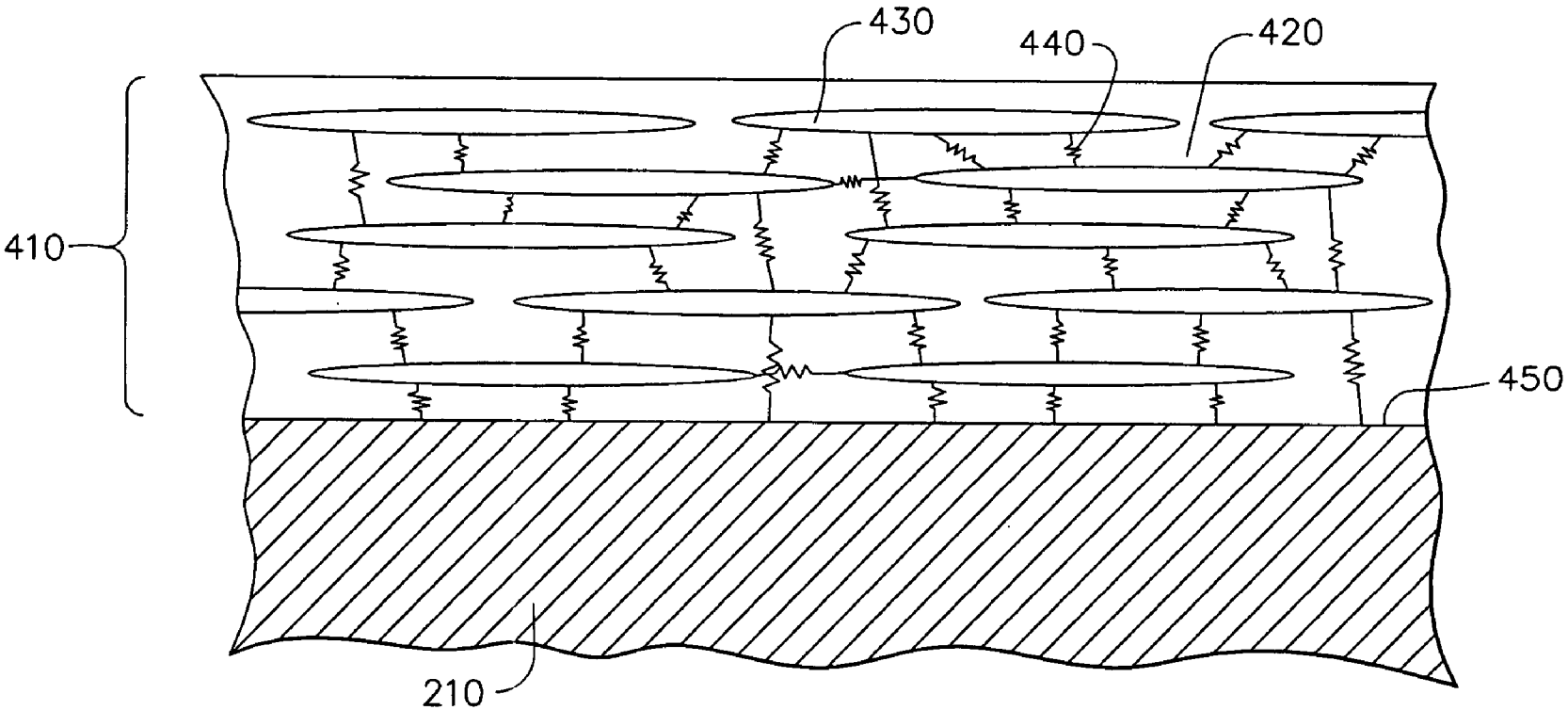
FIG. 5 illustrates a schematic view of a coating according to an embodiment of the present invention.

FIG. 5 shows binder 420 from FIG. 4, including the cutaway blisk blade 210 and damping coating 410 disposed thereon including a schematic view of the components of the damping coating 410. The damping coating 410 includes a binder 420 and a filler material 430, bound by coupling 440. The binder may include visco-elastic material which is permitted to deform between the stiffer elements of the blade and the dispersed particles. The visco-elastic material may be any material suitable for exposure to the operational temperature and rotational forces of the blisk 200 and has the capability of binding the filler material 430. Suitable visco-elastic materials include, but are not limited to rubber, silicone, fluoro-elastomer, or urethane. The filler material 430 includes small, dense, flattened particles or plates. Filler material 430 may include any material that interacts within the binder 420 to produce vibrational damping. Suitable filler materials 430 include, but are not limited to metallic particles, carbon, graphite or silicates. Couplings 440 represent the forces between the particles of the filler material 430, providing interaction between the particles of the filler material 430 that provide vibration damping. Couplings 440 are not a material, such as filler material 430, but represent a dynamic mechanical feature. Although FIG. 5 illustrates couplings 440 as a plurality of individual forces between particles of the filler materials 430, the couplings 440 may also be branched or interrelated forces between the particles of the filler material 430. These forces are applied through binder 420. The binder 420 provides the forces of the couplings 440 and varies based upon the type of binder 420 utilized.

The thickness of the damping coating 410 is sufficient to permit the damping coating 410 to remain adhered to the blade surface during blade operation. The coating may include thicknesses from about 0.03 to about 0.2 inches. The thicknesses may vary depending on aero-mechanical considerations and are preferably sufficiently thick to provide vibrational damping, but does not add excessive additional weight to the blade.

The damping coating 401 may be applied to the blisk blades 210 or fan blades 120 by any suitable technique, including, but not limited to molding onto the surface, spray application or bonding of sheet stock. Temperature exposure considerations of the final coating will dictate the final selection of binder material and application processing. Material for the binder 420 preferably have elasticity over a temperature range between about −65° F. to about 400° F. The particle size, shape, materials and volume density may be determined by the amount of damping required and process compatibility.

Damping is provided by interactions between filler material 430 particles within the damping coating 410, shown as couplings 440 in FIG. 5, and between the composite damping coating 410 and the blade surface 450. FIG. 5 illustrates the couplings 440 of the blisk blade 210 or fan blade 120 structure and the filler materials 430 by the deformable matrix of the binder 420. The amount of damping is controlled by the stiffness of the binder 420 and the packing density or relative proximity of the filler materials 430. Stiff matrices increase resistance to motion between the particles.

In addition, increased density of filler material 430 for a given binder 420 also increases the resistance to motion. The size of the particles of the filler material 430 is dependent upon the application methods used. Larger particles increase the amount of stable mass in the system; however, smaller particles may be more compatible with automated processing methods.

As the present invention is a surface application, it may be combined with other damping approaches. The damping coating 410 may be utilized as a constraint layer between the blade surface and other blade constraint layers attached by the coating as an adhesive. Use of shrouds or other dynamic damping mechanisms may be employed, as desired, to increase overall damping performance.

A damping coating 410 according to the invention includes a binder 420 and a filler material 430. The binder 420 is preferably any visco-elastic material capable of binding the filler material 430 to form a matrix and capable of withstanding the conditions of a fan rotor blade. Suitable visco-elastic materials include, but are not limited to rubber, silicone, fluoroelastomer, and urethane. One preferred binder includes VITON® fluoroelastomer. VITON® is a federally registered trademark owned by DuPont Dow Elastomers L.L.C., Delware. VITON® fluoroelastomers are well-known polymer materials resistant to a wide range of temperature exposure and aggressive atmospheres. The filler material 430 includes small, dense, flattened particles or plates. The filler material 430 is incorporated into the binder 420 to create the vibration damping coating 410. The filler material 430 is any material that is capable of being bound in the matrix and damps vibrations in blisk blades 210 or fan blades 120. Suitable filler materials 430 include, but are not limited to metallic particles. Other high modulus materials, particularly those with low density such as carbon, graphite or silicates may also be employed in the damping system. Key attributes for the filler materials 430 are high strain capability with a low density. Particulate geometry and orientation are also factors having control over the amount of damping obtained by the system. Suitable filler material 430 geometries include, but are not limited to, flattened disks, oblong shapes, and whiskers. Particularly suitable geometries includes geometries that may be uniformly oriented within the binder 420 and are capable of interacting throughout the damping coating 410 to reduce vibration and maintaining a minimal thickness. Filler material 430 particles may range from about 20 microns to about 0.125 inches in length. Suitable aspect ratios for the area to thickness aspect ratio from about 100:1 to about 1000:1. The particular aspect ratio may depend upon the application process and binder 420 utilized. Incorporation of the particles into sheet stock, such as by rolling, calendering or milling, may permit larger particles to be used in the coating than permitted by an extrusion or injection process.

Shaped filler materials 430 of various metallic and non-metallic composition are available commercially from a number of sources. Specialized materials for high temperature or oxidative environments may be provided to accommodate specific applications.

Carbon graphite fiber or disk filler materials 430 offer superior stiffness and density attributes which are preferred for inclusion in the flexible binder matrix. Protection against moisture infiltration into the damper system is important to protect the integrity of the filler materials 430. Additional protective coatings may be added and will tend to wear over time, exposing the materials of the damping coating 410. The wear and exposure of the materials results in the lightweight, metallic filler material 430 being a preferred filler material 430.

The coating materials, including the binder 420 and the filler material 430 are applied to a surface of the substrate. The substrate is preferably a fan blade 120 or a blisk blade 210. Suitable coating methods include, but are not limited to, molding the matrix and filler material 430 onto the substrate, spraying the matrix and filler material 430 onto the substrate and bonding sheet stock of the matrix and filler material 430 to the substrate. In one embodiment of the invention, bonding may be achieved by application of adhesive or primer prior application of the binder 420 and filler material 430. In another embodiment of the invention, the binder 420 and filler material 430 are applied to the surface and cured to adhere the damping coating 410 to the surface. In another embodiment, fluoroelastomeric binders 420, such as VITON®, containing filler material 430, are cured to form a damping coating 410 having good adhesion to fan blade 120 or blisk blade 210 substrates. The coating application method selected is dependent upon the structure of the component and the desired or maximum allowable thickness of the damping coating 410. For example, complex, closely positioned components may lend themselves to application via molding whereas bonding of sheets may be prohibitive. Spray application may be more suitable for large area coverage, while smaller areas are more amenable to sheet applications which may retain tighter dimensional tolerance. Field repair of these materials for aerodynamic performance retention is possible using a cut and match or fill methodology. Damping effectiveness may be effected by the method of application utilized.

Fan blades 120 and blisk blades 210 are subject to conditions including high velocity rotation, high temperature, and large temperature range. During these operating conditions, the materials must be able to withstand temperature exposures from about −65° F. to about 450° F. and endure structure and aerodynamic loadings in excess of 100,000 g's which may be created by rotation velocities of the blade components. The binder 420 used in the coating of the present invention preferably retains adhesion capability to the substrate and filler materials 430 during operation of the fan blade 120 or blisk blade 210.

The thickness of the damping coating 410 is preferably less then 1/16 of an inch. Suitable thickness includes, but is not limited to about 0.03 to about 0.20 inches. The coating thickness varies according to operational requirement or limitations. Variations in coating thickness over the application area can have adverse system performance impacts on aerodynamics, component weight and/or damping. Excessively thick or non-uniform application of the damping coating 410 may result in additional system vibration or fatigue resulting in coating loss and/or potential damage to adjacent components.

Additional benefits which may be derived from application of the damping coating 410 include, cycle and aerodynamic benefits associated with the surface characteristics of the damping coating 410 if applied in a relatively thick layer. Machining of the profile of the components may allow at least some surface roughness tolerances to be permitted from the polished surface typically desired in aerodynamic components. The tolerance reduction may improve machine time and adhesion characteristics while the coating will provide a smooth surface if applied in a thick layer as compared to the surface profile.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A coated fan rotor blade comprising:

a fan rotor blade; and a coating disposed on said fan rotor blade comprising:

a binder; and a filler made up of a plurality of particles, the particles being configured to provide interaction between the plurality of particles;

wherein the filler material is incorporated into the binder material, and the particles interact to produce vibrational damping; and wherein the binder and filler are configured to withstand temperature exposures from about −65° F. to about 450° F. at high rotational speeds.

2. The coated fan rotor blade of claim 1, wherein the particles have an elongated geometry.

3. The coated fan rotor blade of claim 2, wherein the aspect ratios for the area to thickness aspect ratios for the particles is from about 100:1 to about 1000:1.

4. The coated fan rotor blade of claim 1, wherein the particles are selected from the group consisting of metallic particles, carbon particles, graphite particles, silicate particles and combinations thereof.

5. The coated fan rotor blade of claim 1, wherein the binder is visco-elastic.

6. The coated fan rotor blade of claim 5, wherein the binder is selected from the group consisting of rubber, silicon, fluoro-elastomer and urethane.

7. The coated fan rotor blade of claim 6, wherein the fan rotor blade is a single-piece structure.

8. The coated fan rotor blade of claim 7, wherein the single-piece structure is a blisk rotor.

9. A method for damping vibration of a fan rotor blade comprising:

providing a fan rotor blade;

applying a coating composition to a surface of the fan rotor blade, the composition comprising a binder material and a filler material;

wherein the filler material is a plurality of particles, the particles being configured to provide interaction between the plurality of particles, the particles interacting to produce vibrational damping; and wherein the binder and filler are configured to withstand temperature exposures from about −65° F. to about 450° F. at high rotational speeds.

10. The method of claim 9, wherein the coating includes molding the composition onto the substrate.

11. The method of claim 9, wherein the coating includes spraying the composition onto the substrate.

12. The method of claim 9, wherein the coating includes bonding sheets of material to the substrate.

13. The method of claim 9, wherein the particles have an elongated geometry.

14. The method of claim 13, wherein the aspect ratios for the area to thickness aspect ratios for the particles is from about 100:1 to about 1000:1.

15. The method of claim 9, wherein the particles are selected from the group consisting of metallic particles, carbon particles, graphite particles, silicate particles and combinations thereof.

16. The method of claim 9, wherein the binder material is visco-elastic.

17. The method of claim 9, wherein the fan rotor blade is a one-piece structure.

18. The method of claim 17, wherein the one-piece structure is a blisk rotor.

* * * * *